United States Patent [19]

Baldwin

[11] 4,316,294

[45] Feb. 23, 1982

[54] BATHTUB

[76] Inventor: Naomi G. Baldwin, Arcadia, Utah 84012

[21] Appl. No.: 119,736

[22] Filed: Feb. 8, 1980

[51] Int. Cl.[3] ..... A47K 3/022; A47K 3/12

[52] U.S. Cl. ..... 4/538; 4/575; 4/584; 4/589; 4/593; D23/55

[58] Field of Search ..... 4/538, 539, 573, 575, 4/576, 577, 580, 584, 589, 592, 593, DIG. 5, 658, 488, 511, 513, 546, 552, 559, 571, 609, 650; D23/55

[56] References Cited

U.S. PATENT DOCUMENTS

| | | | |
|---|---|---|---|
| D. 228,133 | 8/1973 | Lippert | D23/55 |
| D. 229,180 | 11/1973 | Mollerstedt | D23/55 |
| D. 236,619 | 9/1975 | Powell | D23/55 |
| 2,549,506 | 4/1951 | Moore | 4/576 |
| 2,695,256 | 11/1954 | DeOlloque et al. | 4/538 X |
| 3,826,629 | 7/1974 | Pryor et al. | 4/538 X |
| 4,069,523 | 1/1977 | Ridgeway | 4/580 |

FOREIGN PATENT DOCUMENTS

| | | | |
|---|---|---|---|
| 1805421 | 5/1970 | Fed. Rep. of Germany | 4/576 |

OTHER PUBLICATIONS

"House and Home", Jul. 1968, p. 110.

*Primary Examiner*—Stuart S. Levy
*Attorney, Agent, or Firm*—Lynn G. Foster

[57] ABSTRACT

A bathtub comprising a body having an insulated interior, preferably wood or pressed wood fibers bonded together by a suitable adhesive, an exposed exterior covering of fiberglass, plastic or the like with a non-skid impervious surface. The body comprises a uniquely configurated concavity or well adapted to comfortably receive the body of any size person and to conserve water while entirely covering the body, with the exception of the head. The well comprises opposed peanut-shaped vertical sidewalls each having an inwardly extending non-splash lip. A contoured area between the sidewalls runs from the front to the back of the tub in the well. The front of the mentioned area comprises a vertical front end wall which merges into a generally horizontal front bottom area which accommodates a standing position by the user when the bathtub is used for showering. The horizontal front bottom area spans on the order of one-third the horizontal length of the well and merges with a declining intermediate bottom area which also spans on the order of one-third the horizontal length of the well beginning at the elevation of the horizontal front bottom area and ending at the lowest point in the well. The last area, which smoothly merges with the intermediate bottom area at the mentioned lowest point of the well to form a sitting region comprises an inclining combination bottom and rear wall area which spans on the order of about one-third of the horizontal length of the well and gradually decreases the depth of the well uniformly from its maximum point to the top edge of the bathtub.

9 Claims, 5 Drawing Figures

BATHTUB

BACKGROUND

1. Field of Invention

The present invention relates broadly to bathtub improvements and more specifically to novel bathtub structure which provide an insulation feature which adds to the comfort of the user and which provides a unique well configuration to comfortably, efficiently and safely service the shower and bath needs of all sized persons.

2. Prior Art

While it is known to provide contoured bathtub with leg elevating structure and while it has been suggested that bathtubs be constructed which have low thermal conductivity, the proposals of the prior art have failed to produce a bathtub which is at all times thermally and physiologically comfortable, is easy to clean, conserves water while providing capacity to accommodate and cover any sized individual, which reduces splashing onto the adjacent floor, which is safe and uniquely provides for shower, bath and overflow drainage.

The following patents are known and are of general interest, though not specifically relevant to the present invention: U.S. Pat. No. 627,318; U.S. Pat. No. 1,298,477; U.S. Pat. No. 2,566,495; U.S. Pat. No. D.229,180; U.S. Pat. No. D.236,619; British Pat. No. 904,763; British Pat. No. 1,381,723 and West German Pat. No. 1,943,650.

BRIEF SUMMARY AND OBJECTS OF THE INVENTION

In brief summary, the present invention comprises improved bathtub constructions which (a) accommodate any sized person from infants to the aged in a seated and, if desired, reclined posture, (b) conserve water while providing sufficient capacity to entirely cover the fully extended body of the user; (c) are safe; (d) provide a comfortable temperature at all times; (e) are comfortable and therapeutic; (f) are easy to clean; (g) have a unique drainage system; (h) reduce splashing on the adjacent floor; (i) are physiologically comfortable; and/or (j) have a convenient shower capability.

The present invention, in its presently preferred form, is implemented by providing a novel bathtub comprising an insulating body having an impervious exposed surface. The concavity of the well of the bathtub is uniquely configurated and contoured to define opposed peanut-shaped sidewalls which are substantially vertical, although contoured while presenting opposed, inwardly directed anti-splash lips. The well region between the sidewalls is continuous and comprises seriatim a substantially vertical front end wall, a generally horizontal front bottom area spanning on the order of about one-third the horizontal length of the well, a declining intermediate bottom area merging with the front bottom area and spanning on the order of about one-third the horizontal length of the well gradually increasing the depth of the well to its maximum depth at a sitting area and an inclined combination bottom and rear wall area merging with the intermediate bottom area and spanning on the order of about one-third the horizontal length of the well gradually increasing the depth of the well from its maximum to a location having zero depth and being contoured to comfortably accommodate the back, neck and head of an adult user.

With the foregoing in mind, it is a primary object of the present invention to provide novel and improved bathtub constructions.

It is a further paramount object of the present invention to provide a novel bathtub which (a) accommodates any sized person from infants to the aged in the seated and, if desired, in a physiologically comfortable reclined posture, (b) conserves water while providing sufficient capacity to entirely cover the fully extended body of any sized user; (c) is safe; (d) provides a comfortable temperature at all times (e) is therapeutic (f) is easy to clean, (g) has a unique drainage system; (h) has a convenient shower capability; and/or (i) reduces splashing.

It is an important further object of the present invention to provide a novel bathtub which is uniquely contoured and configurated for comfortable, safe and effective use.

It is a further paramount object of the present invention to provide a bathtub which conforms to the body shape of a relaxed semi-reclined person.

It is a further major object of the invention to provide a bathtub having an elevated leg and foot area as an aid to circulation, which reduces the amount of water used and which provides a standing area for purposes of showering.

It is a further important object of the invention to provide a bathtub having a generally centrally disposed lowered seating area adjacent a main drain providing greater tub depth for the more massive part of the body to enhance total body immersion.

Another significant object of the present invention is the provision of a bathtub having opposed projecting lips which reduce splashing onto the adjacent floor;

Another main object of the present invention is the provision of one or more safety bars to aid the user in accessing into and out of the tub and/or to stabilize the user while showering.

These and other objects and features of the present invention will be apparent from the following detailed description taken with reference to the accompanying drawings.

DETAILED DESCRIPTION OF THE ILLUSTRATED EMBODIMENT

Figure 2:
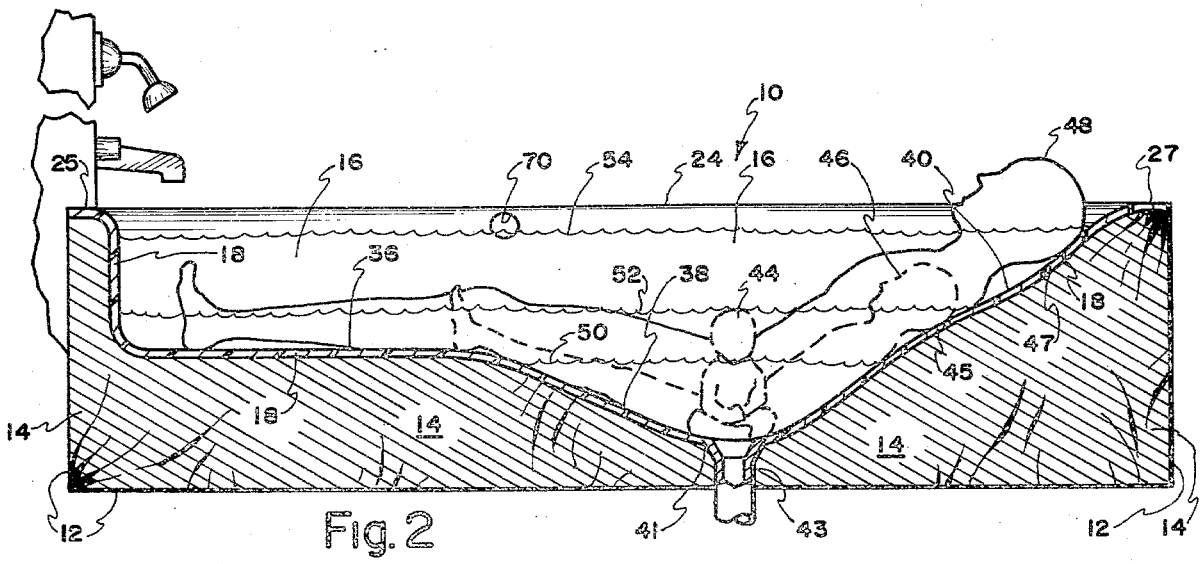
FIG. 2 is a longitudinal cross section taken along line 2—2 of the bathtub of FIG. 1.
Figure 3:
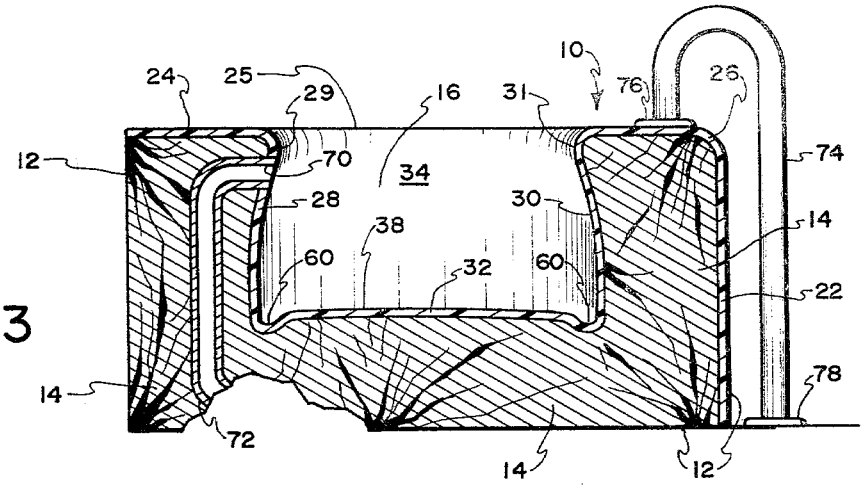
FIG. 3 is a transverse cross section taken along line 3—3 of the bathtub of FIG. 1.
Figure 4:
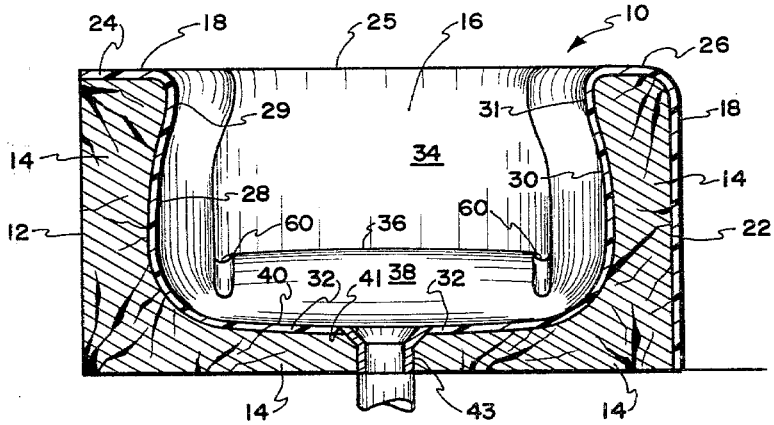
FIG. 4 is a transverse cross section taken along line 4—4 of the bathtub of FIG. 1.
Figure 5:
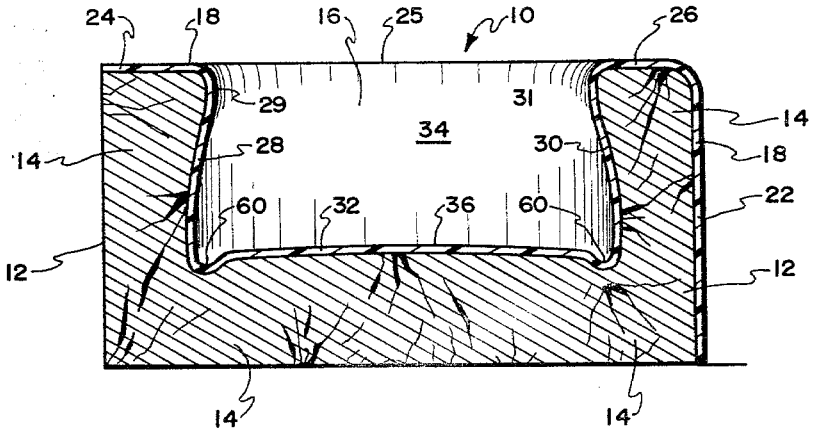
FIG. 5 is a transverse cross section taken along line 5—5 of FIG. 1.

Reference is made specifically to the drawings wherein like numerals are used to designate like parts throughout and which illustrate a presently preferred bathtub embodiment, generally designated 10, made in accordance with the present invention. The bathtub 10 comprises a main body 12 which is generally rectangular in external configuration. The main body comprises a substantial mass of interior insulation 14, which is generally U-shaped in traverse cross section, as illustrated in FIGS. 3-5 and is also longitudinally contoured as illustrated in FIG. 2. The mass of insulation 14 is preferably wood, hardwood being more suitable than softwood. The insulation may also be bonded wood fibers, for example particle board composition. Thus, the bathtub is thermally comfortable while durable and damage resistant. It is to be appreciated that the outside periphery of the bathtub 10, while illustrated as being generally rectangular or cubical, may comprise various shapes to accommodate desired peripheral design and free standing corner, sunken or other placement.

The interior, concavity or bathtub well 16 is uniquely configurated for comfort, safety and efficiency, as hereinafter more fully explained.

The exposed portion of the exterior and the exposed peripheral portion of the concavity or well 16 of the bathtub 10 are covered by an impervious layer of material 18, the surface of which is preferably non-slippery, scratch resistant and water repellant. The exposed layer 18 may, for example, be fiberglass, melamine plastic, or other synthetic resinous material. Because of the contoured nature of the well 16, it is preferred that the layer or covering 18 be such as can be caused to shape and conform readily to the indicated contour during fabrication.

The layer 18 comprises a substantially vertical outside peripheral portion 20 covering the back end of the body 12. See FIG. 1. The layer 18 further comprises a substantially vertical outside peripheral portion 22 covering the exposed side of the body 12, upper side edge portions 24 and 26 covering the elevated side edges of the body 12 on each side of the well 16 and upper end edge portions 25 and 27. It is to be appreciated that the layer 18 is continuous, the adjoining parts thereof being integral with each other. The layer 18 within the well 16 comprises opposed generally vertical sidewalls 28 and 30 and a contoured region 32 within the well 16 between the sides 28 and 30 and extending from the edge 25 of the tub at the front thereof to the edge 27 of the tub at the rear thereof.

The well of concavity 16 thus comprises opposed peanut-shaped or reverse curve lobe shaped generally vertical sidewalls 28 and 30. Opposed elevated anti-splash and water conserving lips 29 and 31 are provided by the sidewalls 28 and 30. The region 32 between the sidewalls 28 and 30 comprises seriatim a substantially vertical front end wall 34, a generally horizontal flat bottom area 36 spanning on the order of about one-third the horizontal length of the well, a declining intermediate bottom area 38 also spanning on the order of about one-third the horizontal length of the well and an inclined bottom and rear wall area 40 spanning on the order of about one-third the horizontal length of the well. The mentioned areas 36, 38 and 40 integrally merge one with the next, the intermediate bottom area 38 gradually increasing the depth of the well to a maximum at sitting and drain site 41. The combination bottom and rear wall area gradually increases the depth of the well from its lowest point at the sitting and drain site 41 to a zero depth location at the rear elevated edge 27 of the bathtub. The interface at the lowest point in the well between the areas 38 and 40 thus comprise a lowered sitting area to allow for greater tub depth for the more massive part of the human body thereby accommodating total body immersion of any sized person, except for the person's head.

The inclined area 40 is provided with reverse surface curves 45 and 47 which generally conform to the shape of the back, neck and head of the adult user, grealy enhancing the physiological comfort associated with the bathtub 10.

A main drain 43 at drain site 41 is centrally located, merges smoothly with the covering or exterior layer 18 and provides for discharge of used water from the well 16 through the body of insulation 14 to a conventional sewer system. A manual stopper may be used to close the drain 43. Alternatively, if desired a conventional valve may be associated with the drain 43, as is well known in the art, but such does not per se comprise part of the present invention.

FIG. 2 illustrates the manner in which any sized person may utilize the contoured well 16 with various levels of water. Note the infant 44 in an erect seated position, the youth 16 in a reclined seated position and the adult 48 in a reclined seated position associated respectively with water levels 50, 52 and 54. Thus, the body of the user of any size is provided with total immersion, with the exception of the user's head, in such a fashion as to provide a conservation of water depending upon the size of the individual. Full body extension is accommodated.

The horizontal front bottom area 36 accommodates two purposes, i.e. an elevated standing site for showering and an elevated leg and foot rest area which is comfortable and aids in cardiovascular circulation during bathing while reducing the amount of water used in the bathtub. The insulated body tends to retain the original temperature of water for improved comfort.

The rounded contoured nature of the well 16 and the drain at the lowest point accommodate easy cleaning.

Sloped exposed well grooves 60 comprise water drainage structure which exists adjacent each sidewall 28 and extend generally in an axial direction from the front bottom area 36 to the intermediate bottom area 38. Thus, during showering, rapid gravitational drainage from the front bottom area 36 to the drain site 41 occurs without puddling. Likewise, following bathing, water which would otherwise tend to accumulate in the region of the horizontal front bottom area is immediately drained by the well grooves 60. A slight transverse crown must be provided to the area 36 to enhance flow to the two side well grooves 60.

The bathtub 10 is provided with an overflow drain comprising an elevated ingress opening 70 (FIGS. 1, 2 and 3) in the layer 18 at the midpoint of sidewall 28. Ingress opening 70 is in flow communication with an overflow drain pipe 72 (FIG. 3). Overflow drain pipe 72 may be connected directly in a conventional fashion to the main drain pipe 43 or, also conventionally independently to a domestic sewer. The ingress opening 70 of the overflow drain is disposed above the normal maximum water line 54 (FIG. 2). As can be seen by observation of FIG. 3, the overflow drain 72 is contained for part of its length at least within the body of insulation 14.

Figure 1:
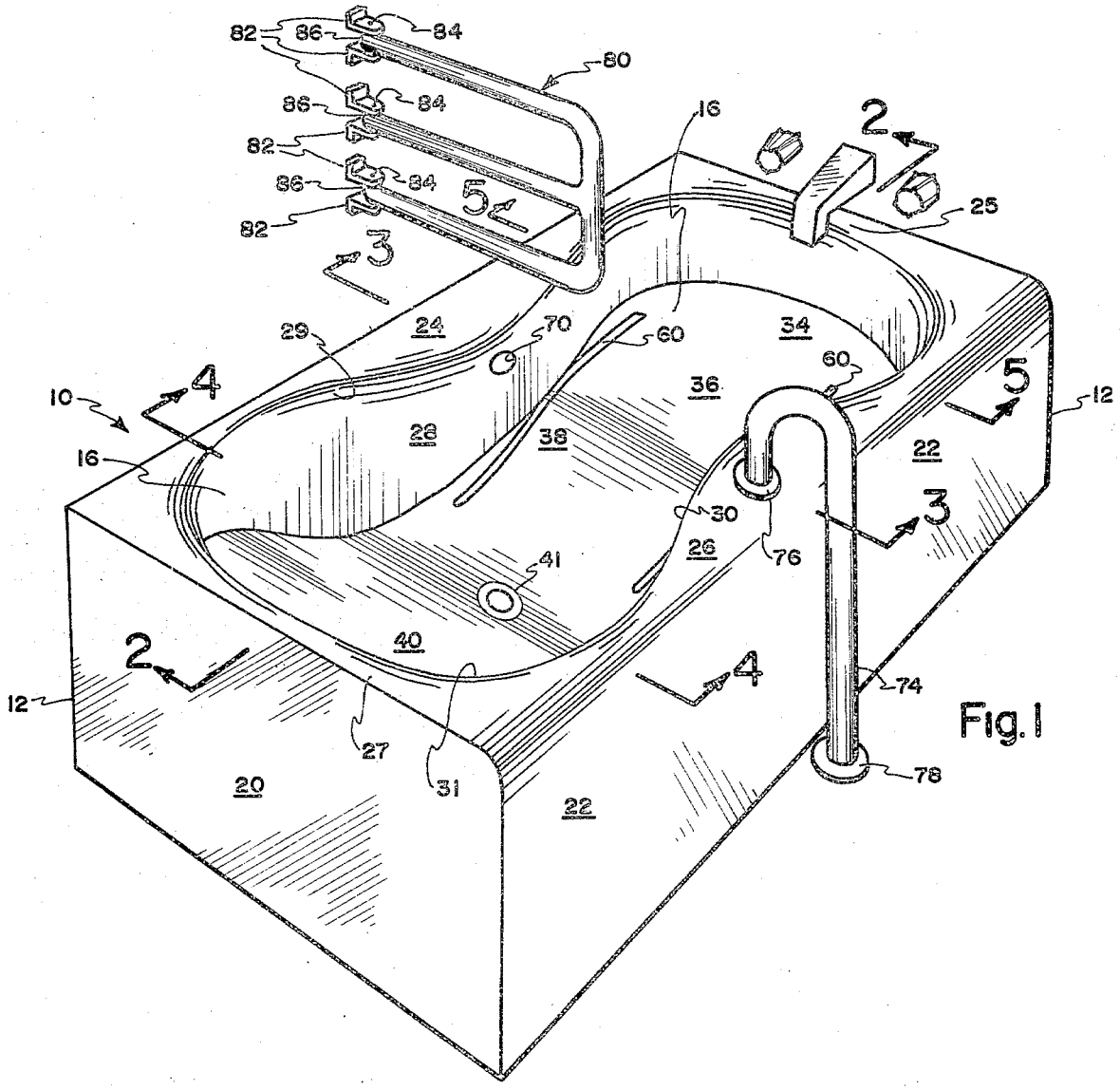
FIG. 1 is a perspective representation of one presently preferred novel bathtub in accordance with the present invention.

As illustrated in FIGS. 1 and 3, the bathtub 10 is provided with an inverted J-shaped safety bar 74 which is rigidly anchored in any suitable fashion at its elevated end 76 to the bathtub edge 26 and at its lower end 78 to the floor adjacent the vertical wall 22. The user of the tub may thus grasp the safety bar 74 as an aid in getting into and out of the well 16 of the bathtub 10. The bar 74 is located so as not to interfere with a shower curtain or the like. The safety bar 74 may be constructed of any suitable material such as metal tubular stock, plastic tubing, fiberglass rod or the like.

The bathtub embodiment 10 comprises a hinged E-shaped safety gate or bar, generally designated 80, which is wall mounted pivotally upon wall brackets 82 centrally above and eccentric to the well 16. Any suitable bracket 82 may be used but must be provided with a conventional detent or latch mechanism. The E-shaped bar is pivotally connected by a pivot pin 84 to the brackets 82 at free ends 86 of the safety gate. Thus, the safety gate 80 may be pivoted into a position substantially parallel to the wall upon which it is mounted when not in use and from thence to a position projecting away from the wall to aid the user while showering.

The invention may be embodied in other specific forms without departing from the spirit or essential characteristics thereof. The present embodiment is therefore considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A bathtub comprising:

main body means comprising wood insulation means and an exposed exterior;

the exterior comprising a water receiving well and an impervious surface;

the well comprising opposed peanut-shaped generally vertical sidewalls and an area between the sidewalls, said region being continuous and comprising seriatim a substantially vertical front end wall, a generally horizontal but slightly crested front bottom area spanning on the order of one-third the horizontal length of the well contiguously receiving and supporting the calves and feet of any sized user in an elevated posture, an intermediate bottom area smoothly merging with the front bottom area and spanning on the order of about the middle one-third of the horizontal length of the well contiguously receiving and supporting the thighs of the user, the intermediate bottom area gradually increasing the depth of the well to its maximum, the maximum depth comprising a concave sitting site contiguously receiving and supporting the buttocks of the user and an inclining combination bottom and rear wall area spanning on the order of about one-third the horizontal length of the well and gradually decreasing the depth of the well from its maximum at the sitting site where the combination bottom and rear wall area joins the intermediate bottom area to a location having zero depth, the combination bottom and rear wall area contiguously receiving and supporting the back, shoulders and head of the user; wherein the front bottom are comprises a slightly crested standing region for showering, and the intermediate bottom and combination bottom and rear wall areas descending to from a concave region accommodating receipt of the massive part of the body of any sized person and further comprising exposed gravity drain means accommodating flow of water down shallow indentations or grooves near the sidewalls of the showering region into the concave region thus preventing puddling of water and the forming of slick spots, and wherein the sidewalls comprise elevated inwardly directed anti-splash lips.

2. A bathtub according to claim 1 wherein the interior insultation means comprise a substantial mass of insulating wood contiguous with the concealed exterior surface of the impervious surface.

3. A bathtub according to claim 2 wherein the wood is hardwood.

4. A bathtub according to claim 2 wherein the interior insulation means comprises a substantial mass of bonded wood fibers.

5. A bathtub according to claim 1 wherein the exterior surface of the well comprises shaped fiberglass.

6. A bathtub according to claim 1 wherein the exterior surface of the well comprises a shaped layer of synthetic resinous material.

7. A bathtub according to claim 1 further comprising an overflow drain contained within and not protruding outside the interior insulation means having an egress opening through the exterior surface at an elevated site in one of the sidewalls.

8. A bathtub according to claim 1 further comprising main drain means contained within the interior insulation means and exposed through the exterior surface at the sitting site by which water in the well is caused to flow to the sewer.

9. A bathtub according to claim 1 wherein the combination bottom and rear wall area is gently indulating and contoured to comfortably accommodate all sizes of persons from a nearly reclining, adult to a seated small child fit the back, neck and head of an adult user.

* * * * *